US006675793B1

(12) United States Patent
Saunders

(10) Patent No.: US 6,675,793 B1
(45) Date of Patent: Jan. 13, 2004

(54) SHOCK DAMPENER

(76) Inventor: Charles A. Saunders, 8380 36th Ave., Columbus, NE (US) 68601

( * ) Notice: Subject to any disclaimer, the term of this patent is extended or adjusted under 35 U.S.C. 154(b) by 0 days.

(21) Appl. No.: 10/350,692

(22) Filed: Jan. 24, 2003

Related U.S. Application Data

(60) Provisional application No. 60/351,345, filed on Jan. 24, 2002.

(51) Int. Cl.[7] ..... F41B 5/20

(52) U.S. Cl. ..... 124/89; 188/378; 267/141.1

(58) Field of Search ..... 124/89; D22/107; 188/378; 267/141.1, 153

(56) References Cited

U.S. PATENT DOCUMENTS

| | | | | | |
|---|---|---|---|---|---|
| 4,765,758 | A | * | 8/1988 | O'Donnell et al. | 267/141.1 |
| 5,513,622 | A | * | 5/1996 | Musacchia, Sr. | 124/89 |
| D436,643 | S | * | 1/2001 | Sims | D22/107 |
| 6,298,842 | B1 | * | 10/2001 | Sims | 124/89 |
| 6,382,201 | B1 | * | 5/2002 | McPherson et al. | 124/89 |
| 2003/0056779 | A1 | * | 3/2003 | Gallops | 124/89 |
| 2003/0094168 | A1 | * | 5/2003 | Sims | 124/89 |

* cited by examiner

*Primary Examiner*—Derris H. Banks
*Assistant Examiner*—Urszula Cegielnik
(74) *Attorney, Agent, or Firm*—Kegan & Kegan, Ltd.; Marc E. Fineman

(57) ABSTRACT

An archery bow shock dampener includes three main components—a base, a vibration-absorbing body, and a securement ring. The vibration-absorbing body is formed of an elastomeric material, such as a visco-elastic polymer and is sandwiched between the base and a securement ring. Within the vibration-absorbing body is a central disk having a shaft mounted to one face and projecting outwardly through the vibration-absorbing body and through an opening in the securement ring. An integrated threaded shaft on the base permits the shock dampener to be mounted, in a conventional fashion, on to the body of a bow while the threaded shaft on the central disk permits additional accessories, such as stabilizers, to be connected to the dampener. The dampener also includes an integrated washer, disposed between the vibration-absorbing body and the securement ring, which may tightened against the vibration-absorbing body to eliminate any sag that may occur if additional accessories are mounted on the dampener. In an additional embodiment, the vibration-absorbing body is replaced by a vibration absorbing mechanism in which the central disk is disposed between two elastomeric cushioning rings.

18 Claims, 5 Drawing Sheets

SHOCK DAMPENER

CROSS-REFERENCE TO RELATED APPLICATIONS

This application claims the benefit of U.S. Provisional Application No. 60/351,345, filed Jan. 24, 2002.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates generally to archery bows, and more particularly to an improved apparatus for dampening shocks and vibrations in a bow.

(2) Description of the Prior Art

Stabilizers and shock absorbers for archery bows have been utilized in the archery field for many years. Bows without such systems are affected by the shock and vibrations that occur during the launch and release of an arrow from the bow. Because the trajectory of the arrow is affected by any movement or vibration of the bow during the arrow's launch, it is desirable to reduce and/or eliminate such vibrations to the greatest extent possible.

Various shock and vibration dampening devices have been developed to minimize shock and vibration. However, the success such devices is a function of vibration absorbing qualities of the device. Some dampening devices simply attach weighted bodies to the bow, with the extra weight absorbing a portion of the vibration. However, the success of such dampeners is a function of the weight of the body, with larger bodies absorbing more vibration. Since it is undesirable to substantially increase the weight of a bow and to create potential obstructions, such dampeners are impractical. Other dampening devices seek to absorb vibrations through use of fluids or elastomers, but the operation of such devices tends to be adversely affected by changes in temperature—colder temperatures result in increased dampening while warmer dampeners decrease dampening. Such inconsistent, unpredictable operation is undesirable for archers, who use bows outdoors in varied climates and weather conditions.

Thus, what is needed is an unobtrusive shock dampener that exhibits a high shock and vibration dampening capacity without unduly increasing the weight of the bow. The dampener should also provide predicable, consistent performance and should be efficient and economical to produce.

BRIEF SUMMARY OF THE INVENTION

The shock dampener of the present invention is a small, unobtrusive, lightweight device that exhibits superior shock and vibration dampening qualities. The shock dampener includes three main components, namely, a base, a vibration-absorbing body, and a securement ring. The vibration-absorbing body is preferably formed of an elastomeric material, such as a visco-elastic polymer and is sandwiched between the base and the securement ring. Within the vibration-absorbing body is a preferably rigid central disk having a shaft mounted to one face and projecting outwardly through the vibration-absorbing body and through an opening in the securement ring. An integrated threaded stem on the base permits the shock dampener to be mounted, in a conventional fashion, on to the body of a bow while the central disk's threaded shaft permits additional accessories, such as stabilizers, to be connected to the dampener. The dampener also includes an integrated rigid washer, disposed between the vibration-absorbing body and the securement ring, which may be tightened against the body to eliminate any sag that may occur if additional accessories are mounted on the dampener. In a second embodiment, the single-piece elastomeric vibration-absorbing body is replaced by a multi-piece vibration absorbing mechanism in which the central disk is disposed between two elastomeric cushioning rings.

The objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
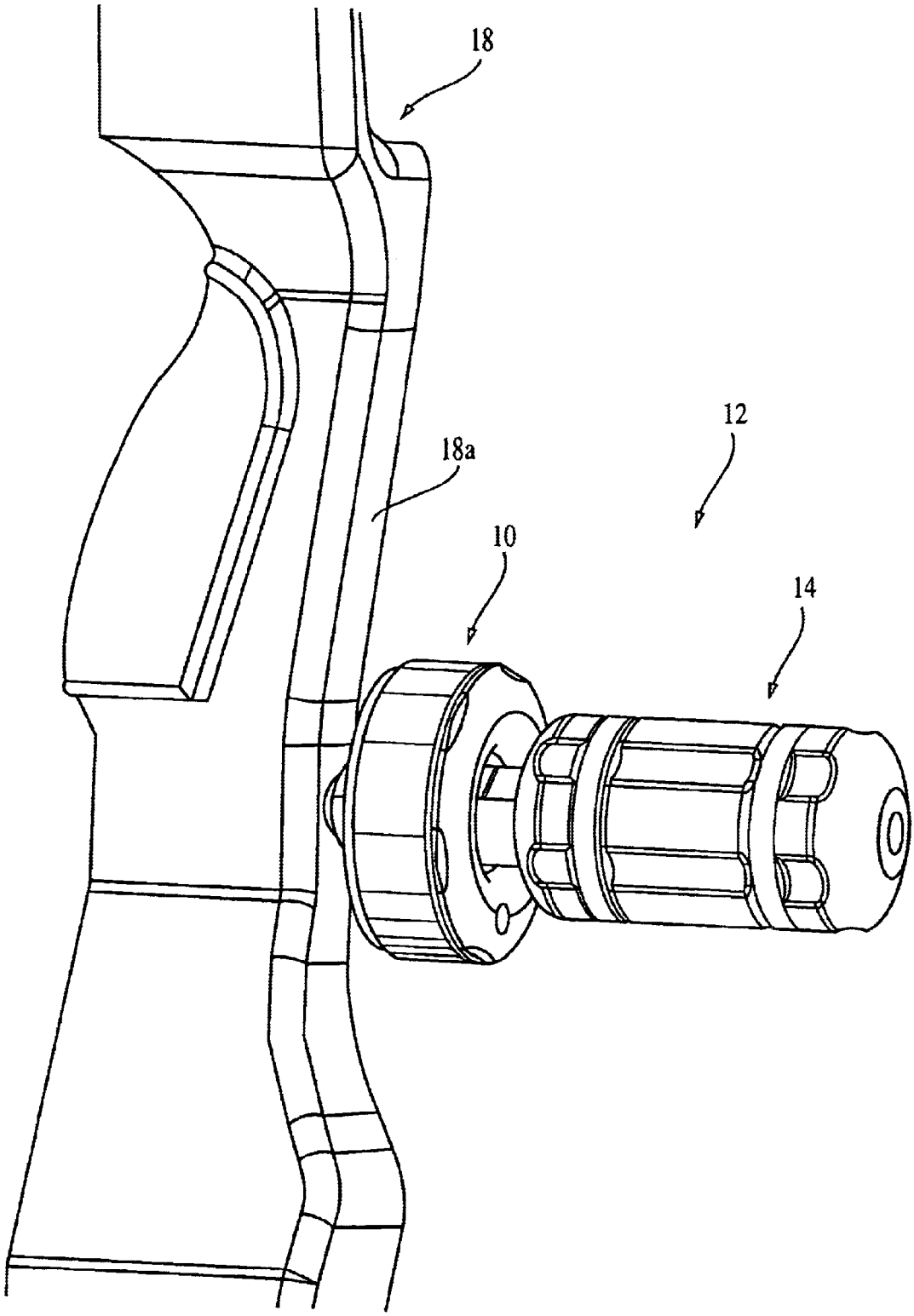
FIG. 1 is a perspective view of one embodiment of the shock dampener of the present invention installed as one component of an integrated shock dampening and stabilizing system attached to an archery bow.

Referring now to the drawings, in which similar or corresponding parts are identified with the same reference numeral, and more particularly to FIG. 1, one embodiment of the shock dampener of the present invention is designated generally at 10 and is shown as a component of an integrated shock dampening and stabilization system 12 that also includes a dynamic stabilizer 14 mounted to a forward face 18*a* of a bow 18.

Figure 4:
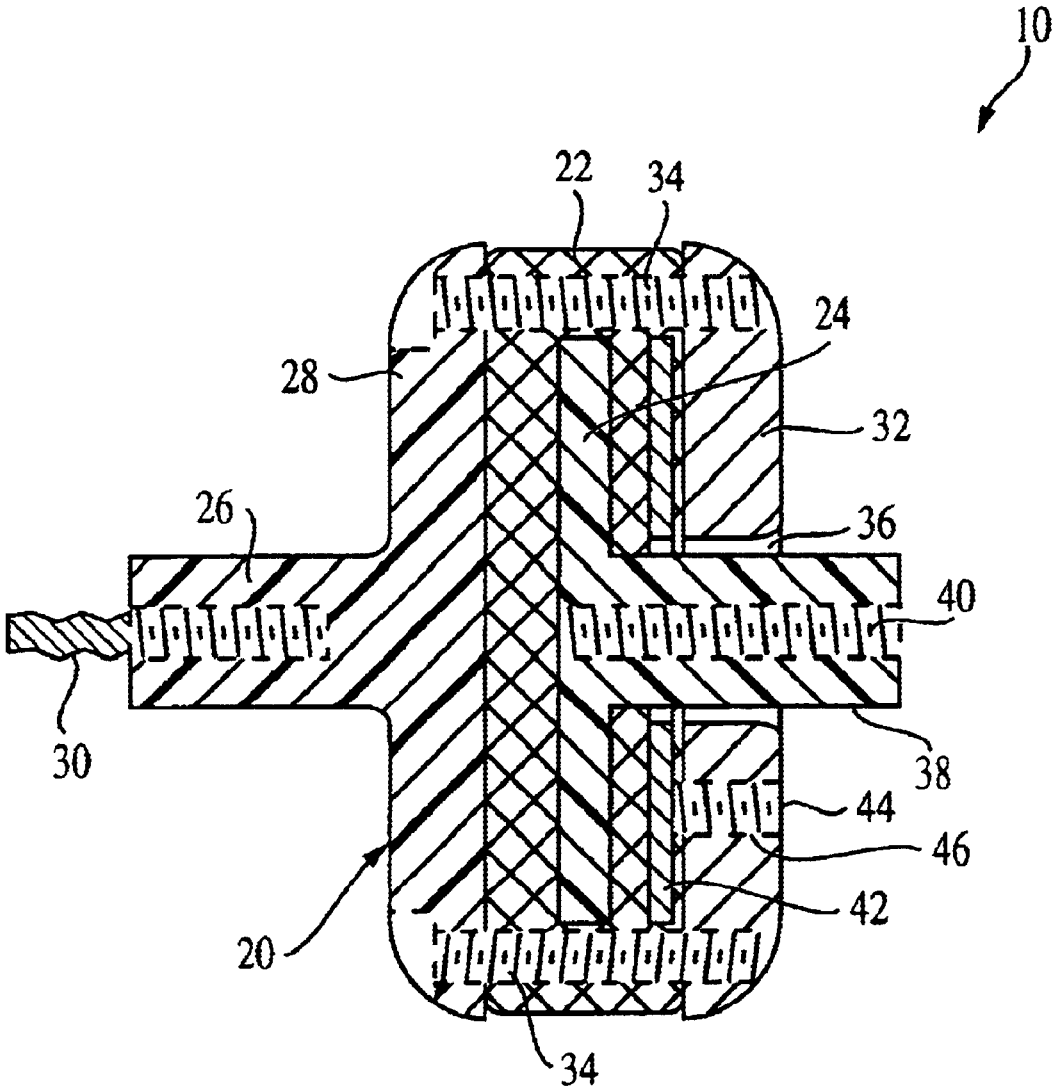
FIG. 4 is a cross sectional view of the preferred embodiment of the shock dampener of the present invention.

Referring now to FIG. 4, the preferred embodiment of the shock dampener 10 of the present invention includes three main components, namely, a base 20, a vibration-absorbing body, 22, and a securement ring 32. Base 20 is constructed preferably of a rigid material and includes a stem 26 extending normal to a generally disk-shaped plate 28, along the central axis of the plate 28. A threaded shaft 30 projecting from the end of the stem 26, permits attachment of the dampener 10 to a threaded aperture in the forward face of the bow, in a conventional fashion, as shown in FIG. 1.

Securement ring 32, also preferably is constructed of a rigid material and is generally disk-shaped, has a diameter generally equal to that of plate 28 of base 20. Securement ring 32 has a central opening 36 through which a shaft 38 (extending from central disk 24 of vibration-absorbing body 22) freely projects, as described in more detail hereinbelow. Securement ring 32 is secured to plate 28 of base 20 by a plurality of bolts 34 passing through vibration-absorbing body 22, with vibration-absorbing body 22 sandwiched between securement ring 32 and plate 28 of base 20.

Vibration-absorbing body 22 preferably is formed of a single-piece of elastomeric material, such as a visco-elastic polymer. Vibration-absorbing body 22 also is generally disk-shaped, with a diameter slightly less than that of plate 28 of base 20 and securement ring 32. Vibration-absorbing body 22 further includes an integrated central disk 24. Central disk 24 preferably is a rigid member disposed centrally within vibration-absorbing body 22, between plate 28 of base 20 and securement ring 32, but which has no portion that is in direct contact with either plate 28 or securement ring 32, or with any other portion of the structure (excluding bolts 34). Central disk 24 has a shaft 38 mounted to one face and projecting from the central axis of central disk 24, outwardly through the vibration-absorbing body 22 and through central opening 36 of securement ring 32. The central opening 36 has a diameter great enough that slight movement of shaft 38 will not contact securement ring 32. Shaft 38 has an axial bore 40 that is threaded to receive the threaded bolt of additional accessories or attachments (for example the dynamic stabilizer 14 as shown in FIG. 1), if desired.

A washer 42 is interposed between securement ring 32 and vibration-absorbing body 22, and has a central opening sufficiently large that shaft 38 projects therethrough without contacting washer 42. A screw 44, threaded through an aperture 46 extending through the thickness of securement ring 32, may be tightened against the washer 42 thereby partially compressing vibration-absorbing body 22 against central disk 24 to eliminate any sag that may occur if a stabilizer or other weighted attachment is connected to shaft 38.

In operation, energy in the form of shocks or vibrations in a bow that occur during the release of an arrow are transferred through shaft 38 to the elastomeric body 22, where they are converted to heat and dissipated.

Figure 2:
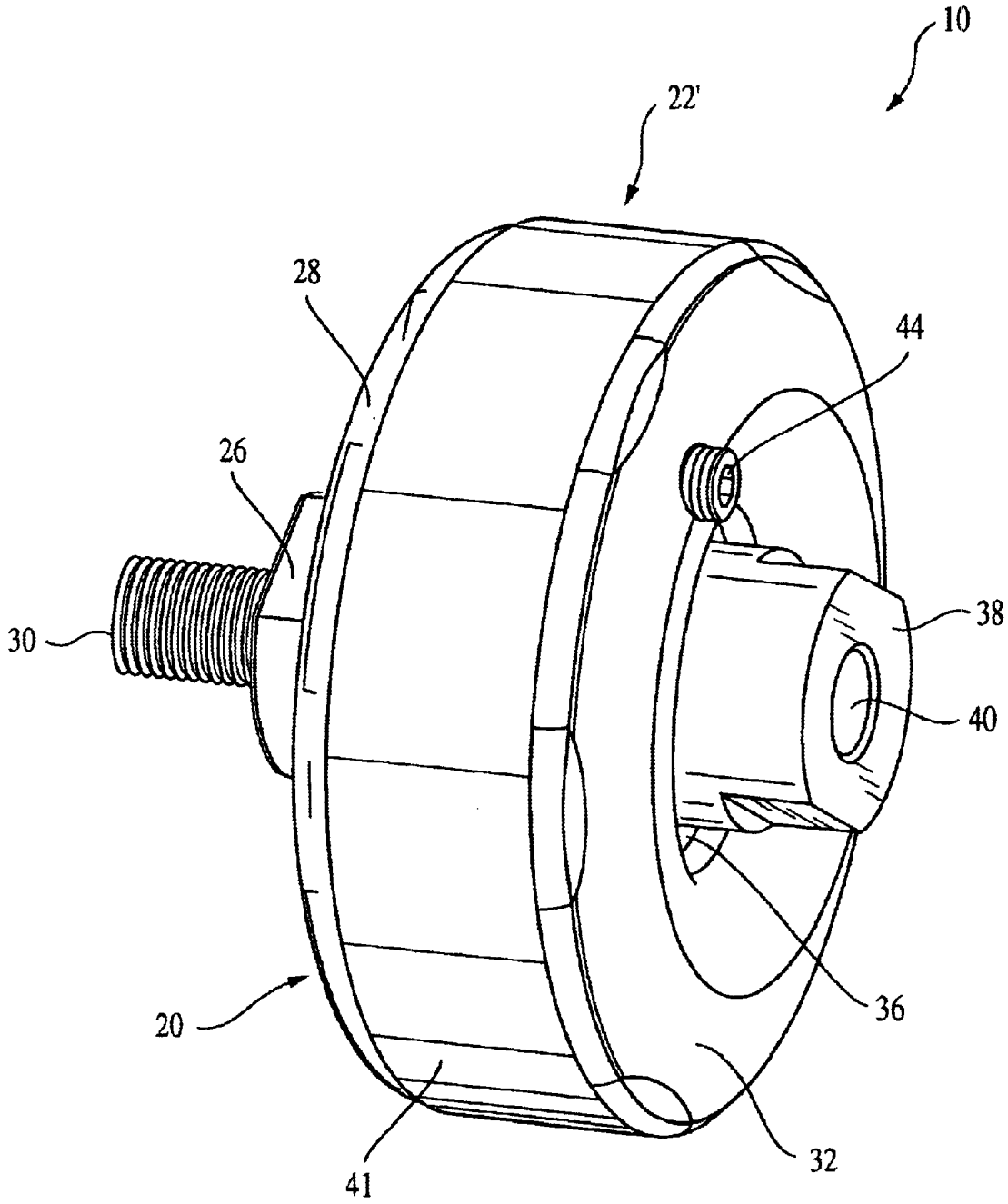
FIG. 2 is a perspective view of one embodiment of the shock dampener of the present invention.
Figure 3:
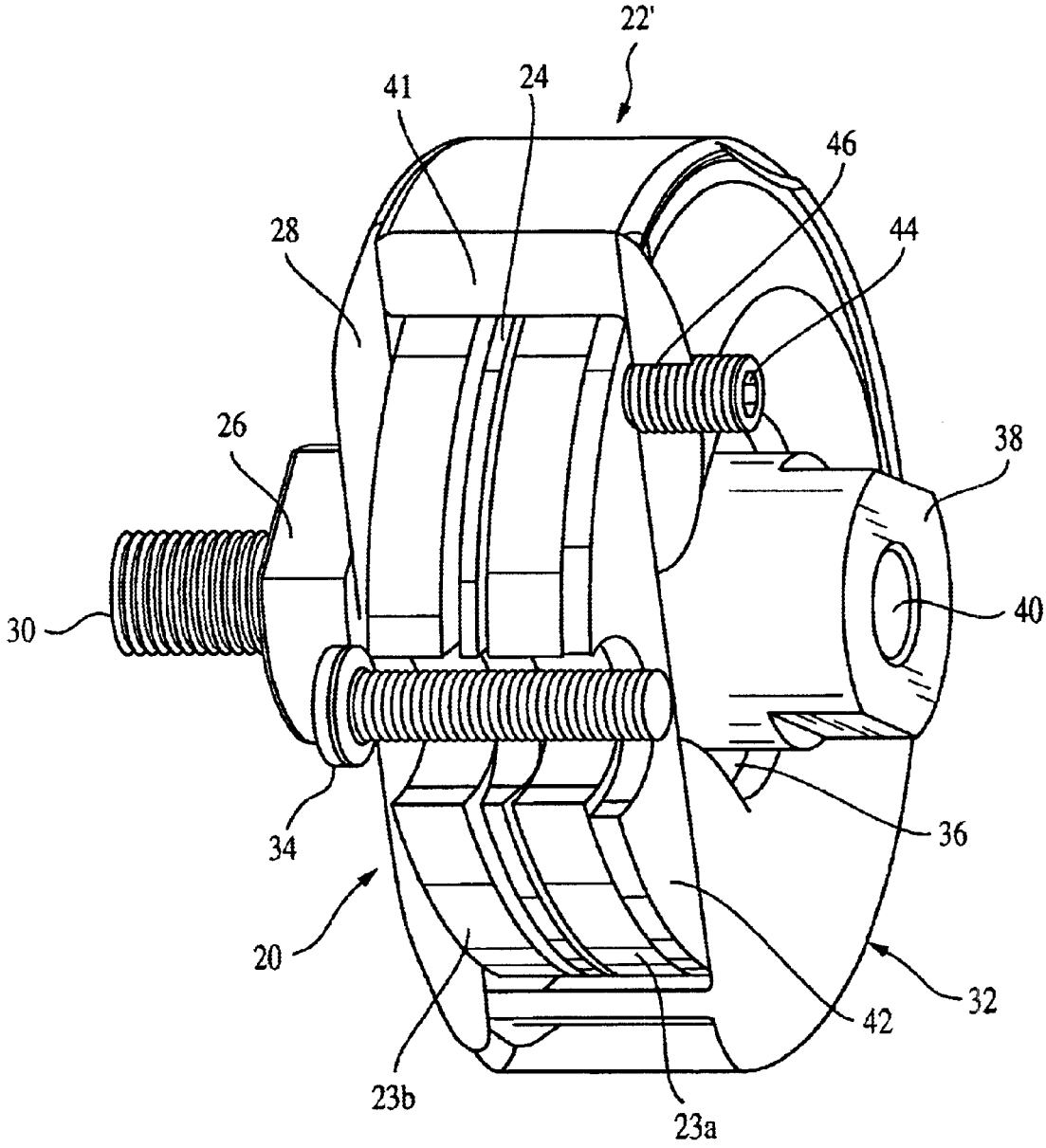
FIG. 3 is a perspective view of the shock dampener of FIG. 2, with portions broken away to show interior details of the invention.
Figure 5:
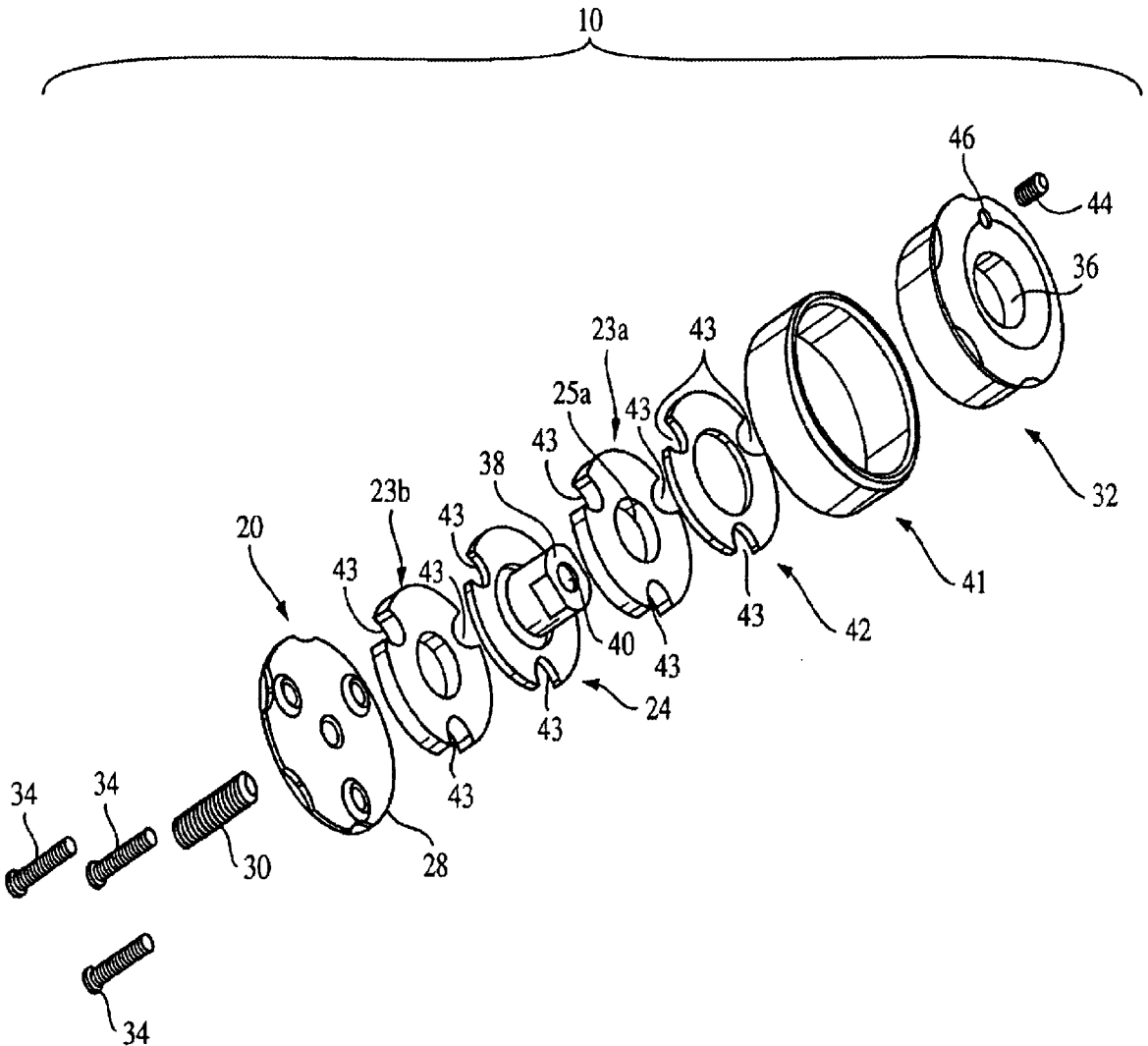
FIG. 5 is an exploded view of one embodiment of the shock dampener of the present invention.

In a second embodiment of the shock dampener of the present invention, as shown in FIGS. 2, 3, and 5, the shock dampener is identical in nearly all respects to the shock dampener of the preferred embodiment, with the exception that single-piece vibration-absorbing body 22 is replaced by multi-piece vibration-absorbing mechanism 22'. Vibration-absorbing mechanism 22' is comprised of central disk 24 disposed between two elastomeric cushioning rings, 23*a* and 23*b*. Cushioning rings 23*a* and 23*b* preferably are formed of the same visco-elastic polymer as vibration-absorbing body 22. Cushioning ring 23*a* includes an opening 25*a* through which shaft 38 of central disk 24 projects before projecting through central opening 36 of securement ring 32. Cushioning rings 23*a* and 23*b* preferably have a diameter generally equal to the diameter of central disk 24 and less than the diameters of plate 28 of base 20 and securement ring 32. Cushioning rings 23*a* and 23*b* preferably have similar thicknesses, and are generally thicker than central disk 24. In this embodiment, cushioning rings 23*a* and 23*b*, along with central disk 24 and washer 42, include cutouts 43 to permit passage of bolts 34 between securement ring 32 and plate 28 of base 20. In this embodiment, screw 44 may be tightened against washer 42 thereby partially compressing cushioning ring 23*a* against central disk 24 to eliminate any sag that may occur if a stabilizer or other weighted attachment is connected to shaft 38. Additionally, a sleeve 41 may surround vibration-absorbing mechanism 22' for aesthetic purposes and for protection of the vibration-absorbing mechanism 22' from the elements.

While a specific embodiment of the invention has been shown and described, it is to be understood that numerous changes and modifications may be made therein without departing from the scope, spirit, and intent of the invention as set forth in the appended claims.

I claim:

1. A shock dampener for an archery bow comprising:

a base comprised of a stem extending rearwardly normal to a plate along a central axis of said plate wherein said stem includes a means to removably attach said shock dampener to said archery bow;

an elastomeric vibration-absorbing body;

a central disk disposed centrally and integrated within said vibration-absorbing body wherein said central disk includes a shaft extending forwardly normal to said central disk along a central axis of said central disk;

a securement ring having a central opening through which said shaft freely projects; and a means to secure said base to said securement ring wherein said vibration-absorbing body is disposed between said base to said securement ring;

wherein said central disc does not contact said base and said securement ring.

2. The shock dampener of claim 1 wherein said means to removably attach said shock dampener to said archery bow comprises a threaded shaft extending rearwardly from said stem for connecting to a mating aperture in a forward face of said archery bow.

3. The shock dampener of claim 1 wherein said shaft includes a means to removably attach additional archery bow accessories to said shock dampener.

4. The shock dampener of claim 3 wherein said means to removably attach additional archery bow accessories to said shock dampener comprises a threaded axial bore in said shaft to matingly receive said additional archery bow accessories.

5. The shock dampener of claim 1 wherein said means to secure said base to said securement ring comprises a plurality of bolts.

6. The shock dampener of claim 3 further comprising a means to eliminate sag when additional archery bow accessories are attached to said shock dampener.

7. The shock dampener of claim 6 wherein said means to eliminate sag when additional archery bow accessories are attached to said shock dampener comprises a washer interposed between said securement ring and said vibration-absorbing body and a screw threaded through an aperture in said securement ring, wherein said screw may be tightened against said washer thereby compressing said vibration-absorbing body against said central disk.

8. The shock dampener of claim 1 wherein said elastomeric vibration-absorbing body is composed of a visco-elastic polymer.

9. A shock dampener for an archery bow comprising:

a base;

an elastomeric vibration absorbing body;

a central disk disposed centrally and integrated within said vibration-absorbing body;

a securement ring; and a means to secure said base to said securement ring wherein said vibration-absorbing body is disposed between said base and said securement ring;

wherein said central disc does not contact said base and said securement ring.

10. A shock dampener for an archery bow comprising:

a base comprised of a stem extending rearwardly normal to a plate along a central axis of said plate wherein said stem includes a means to removably attach said shock dampener to said archery bow;

a securement ring having a central opening;

a vibration-absorbing mechanism wherein said vibration-absorbing mechanism comprises a central disk having a shaft extending forwardly normal to said central disk along a central axis of said central disk and freely projecting through said opening in said securement ring, and a plurality of elastomeric cushioning rings disposed between said central disk and said plate and between said central disk and said securement ring; and a means to secure said base to said securement ring wherein said vibration-absorbing mechanism is disposed between said base to said securement ring;

wherein said central disc does not contact said base and said securement ring.

11. The shock dampener of claim 10 wherein said means to removably attach said shock dampener to said archery bow comprises a threaded shaft extending rearwardly from said stem for connecting to a mating aperture in a forward face of said archery bow.

12. The shock dampener of claim 10 wherein said shaft includes a means to removably attach additional archery bow accessories to said shock dampener.

13. The shock dampener of claim 12 wherein said means to removably attach additional archery bow accessories to said shock dampener comprises a threaded axial bore in said shaft to matingly receive said additional archery bow accessories.

14. The shock dampener of claim 1 wherein said means to secure said base to said securement ring comprises a plurality of bolts.

15. The shock dampener of claim 12 further comprising a means to eliminate sag when additional archery bow accessories are attached to said shock dampener.

16. The shock dampener of claim 15 wherein said means to eliminate sag when additional archery bow accessories are attached to said shock dampener comprises a washer interposed between said securement ring and one of said plurality of elastomeric cushioning rings and a screw threaded through an aperture in said securement ring, wherein said screw may be tightened against said washer thereby compressing said one of said plurality of elastomeric cushioning rings against said central disk.

17. The shock dampener of claim 10 wherein said plurality of elastomeric cushioning rings are composed of a visco-elastic polymer.

18. The shock dampener of claim 10 further including a sleeve to protect said vibration-dampening mechanism.

* * * * *